US007033538B2

(12) United States Patent
Eckert

(10) Patent No.: US 7,033,538 B2
(45) **Date of Patent: *Apr. 25, 2006**

(54) HEATED TROUGH FOR MOLTEN ALUMINUM

(76) Inventor: C. Edward Eckert, 260 Lynn Ann Dr., New Kensington, PA (US) 15068

( * ) Notice: Subject to any disclaimer, the term of this patent is extended or adjusted under 35 U.S.C. 154(b) by 83 days.

This patent is subject to a terminal disclaimer.

(21) Appl. No.: 10/771,567

(22) Filed: Feb. 5, 2004

(65) Prior Publication Data

US 2004/0155389 A1 Aug. 12, 2004

Related U.S. Application Data

(60) Continuation-in-part of application No. 10/194,540, filed on Jul. 15, 2002, now abandoned, which is a division of application No. 09/706,391, filed on Nov. 6, 2000, now Pat. No. 6,444,165, which is a continuation of application No. 09/228,741, filed on Jan. 12, 1999, now abandoned.

(51) Int. Cl.
*C21B 7/14* (2006.01)

(52) U.S. Cl. ..... 266/196; 266/200; 266/231; 266/236

(58) Field of Classification Search ..... 266/196, 266/200, 231, 236, 281
See application file for complete search history.

(56) References Cited

U.S. PATENT DOCUMENTS

| | | | | |
|---|---|---|---|---|
| 4,345,743 | A | 8/1982 | Sivilotti | 266/44 |
| 4,366,255 | A | 12/1982 | Lankard | 501/95 |
| 6,444,165 | B1 * | 9/2002 | Eckert | 266/196 |
| 6,470,041 | B1 * | 10/2002 | Eckert | 373/119 |
| 6,585,928 | B1 * | 7/2003 | Eckert | 266/45 |

FOREIGN PATENT DOCUMENTS

| | | |
|---|---|---|
| DE | 3828515 A1 | 3/1990 |
| JP | 61222939 | 10/1986 |
| JP | 407100630 | 4/1995 |

* cited by examiner

*Primary Examiner*—Scott Kastler
(74) *Attorney, Agent, or Firm*—Andrew Alexander

(57) ABSTRACT

A method of heating molten aluminum flowing in a heated trough member comprising the steps of providing a source of molten aluminum and providing a rough member comprised of a first side and a second side, the first and the second sides having outside surfaces, the sides formed from a ceramic material resistant to attack by molten aluminum. The first side and second side have heating element receptacles provided therein with protection tubes provided in the receptacles. The protection tubes are comprised of a refractory selected from the group consisting of mullite, boron nitride, silicon nitride, silicon carbide, graphite, silicon aluminum oxynitride or a metal selected from Kovar® and titanium. Electric heating elements are positioned in the tubes. Molten aluminum is flowed along the trough member from the source and electric power is passed to the heating elements to heat the molten aluminum as it flows along the trough member.

6 Claims, 2 Drawing Sheets

HEATED TROUGH FOR MOLTEN ALUMINUM

CROSS REFERENCE TO RELATED APPLICATIONS

This application is a continuation-in-part of U.S. Ser. No. 10/194,540, filed Jul. 15, 2002, now abandoned which is a division of U.S. Ser. No. 09/706,391, filed Nov. 6, 2000, issued Sep. 3, 2002 as U.S. Pat. No. 6,444,165, which is a continuation-in-part of U.S. Ser. No. 09/228,741, filed Jan. 12, 1999 (abandoned).

BACKGROUND OF THE INVENTION

This invention relates to troughing for molten metals and more particularly it relates to heated troughing for flowing molten metal such as molten aluminum from one station to another.

Conventional troughing used for conveying molten aluminum from a molten aluminum source such as a holding furnace to a work station such as a degasser or caster is either not heated or if heated, utilizes radian heaters such as glow bars which radiate heat from above the surface of the molten metal. If no heaters are used in the troughing, then the distance the metal can be conveyed is limited or the molten metal must be superheated to compensate for the loss in temperature, with its attendant problems such as skim generation. However, radiant heaters have the problem of short service life because they are exposed to aluminum vapors, splashing of molten aluminum and mechanical abuse. Also, radiant heat has the problem that it results in local heating of the surface of the molten metal in the roughing and deposition of a metal skim on the sidewalls of the troughing which contributes to oxide formation. Thus, it can be seen that there is a great need for an improved troughing for conveying molten metal such as molten aluminum which overcomes these problems. This invention provides such an improved troughing.

SUMMARY OF THE INVENTION

It is an object of this invention to provide an improved refractory troughing.

It is another object of this invention to provide an improved heated trough member for conveying molten metal such as molten aluminum.

It is a further object of this invention to provide a heated refractory trough for flowing molten aluminum from a molten aluminum source to a work station such as a degasser.

These and other objects will become apparent from a reading of the specification and claims appended hereto.

In accordance with these objects, there is provided a method of heating molten aluminum flowing in a heated trough member comprising the steps of providing a source of molten aluminum and providing a rough member comprised of a first side and a second side, the first and the second sides having outside surfaces, the sides formed from a ceramic material resistant to attack by molten aluminum. The first side and second side have heating element receptacles provided therein with protection tubes provided in the receptacles. The protection tubes are comprised of a refractory selected from the group consisting of mullite, boron nitride, silicon nitride, silicon carbide, graphite, silicon aluminum oxynitride or a metal selected from Kovar® and titanium. Electric heating elements are positioned in the tubes. Molten aluminum is flowed along the trough member from the source and electric power is passed to the heating elements to heat the molten aluminum as it flows along the trough member.

DETAILED DESCRIPTION OF THE PREFERRED EMBODIMENTS

Figure 1:
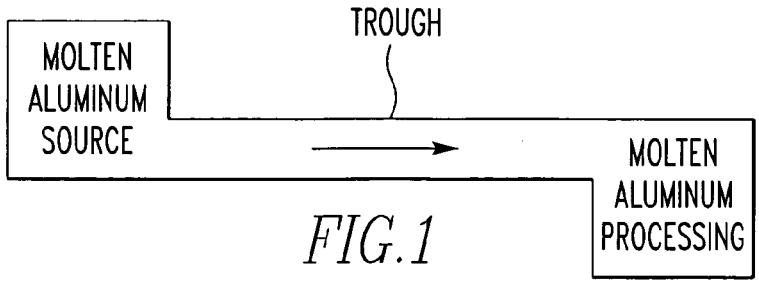
FIG. 1 is a schematic of a molten aluminum source (holding furnace) connected to a processing station, e.g., degasser, by troughing.

The refractory materials useful in the present invention for troughing can include alumina, silica, silicon carbide, base material or mixtures thereof. The refractory material can utilize mullite, kyanite, bauxite and kaolin, for example. Any refractory material may be used, depending on the end use. If the use is high temperature application, then the alumina, silica, or silica carbide are particularly useful. These materials are usually ground to provide a particle size preferably not greater than about 40 mesh with smaller particle size being preferred, e.g., less than about 30 mesh, to facilitate mixing with metal fiber reinforcing or heat conduction material. That is, the use of large particles resist mixing or intrusion into the metal fiber matrix, resulting in voids which adversely affect the integrity of the refractory body. Further, smaller particle size improves the fluidity of the refractory when mixed with a refractory cement prior to infiltrating the metal fiber matrix, when such is used for reinforcing or heat conduction.

For purposes of preparing a mix for infiltrating the metal fiber matrix, the refractory material is mixed with a refractory cement such as calcium aluminate cement, gypsum, sodium silicate or the like to provide a mix. However, any refractory cement may be used, depending on the end use. The cement typically is used in equal parts with the refractory material; however, adjustments can be made to add more or less cement as desired.

It will be appreciated that water is added to the mix in the range of about 10 to 35 wt. % or more to provide a slurry suitable for intruding or pressure infiltrating the metal fiber matrix. Plasticizers may be added to the mix to aid in infiltrating the metal fiber matrix.

Refractory bodies of the present invention have many uses in high temperature applications such as in molten metal, for example, molten aluminum. Thus, it is important that the refractory have high durability and furthermore it is important that the metal component when used for reinforcing has a low coefficient of thermal expansion and preferably high oxidation resistance at elevated temperatures. The low coefficient of thermal expansion is important to avoid cracking of the refractory body at high temperatures. The high oxidation resistance is important to minimize high temperature oxidation in environments where fibers are exposed above the metal line.

In the present invention, the metal component, e.g., metal fibers, are carefully selected to provide the low coefficient of thermal expansion. Thus, the metal component can be comprised of nickel based alloys, iron-nickel based alloys, iron-nickel-cobalt based alloys and titanium based alloys. Preferably, the metal component is comprised of an alloy having a coefficient of thermal expansion of less than $10\times10^{-6}$ in/in/° F. and preferably less than $7\times10^{-6}$ in/in/° F. Typically, such coefficients of thermal expansion are applicable over a temperature range of about 400° to 2000° F. Further, it is preferred that such alloys have an oxidation resistance (as measured by weight gain) of less than about 15 mg/cm$^2$, typically less than 5 mg/cm$^2$.

The nickel based alloys include Incoloy alloys 903, 907, 908 and 909; Inconel alloys 783 and 718; Thermo-Span; Haynes alloy 242; and Nilo alloys 36 and 42. These alloys have the following compositions:

Nominal Chemical Compositions (wt. %)

| | Ni | Fe | Co | Cr | Nb | Al | Ti | Si | Other |
|---|---|---|---|---|---|---|---|---|---|
| Incoloy alloy 903 | 38.0 | 42.0 | 15.0 | — | 3.0 | 0.9 | 1.4 | — | — |
| Incoloy alloy 907 | 38.0 | 42.0 | 13.0 | — | 4.7 | 0.03 | 1.5 | 0.15 | — |
| Incoloy alloy 909 | 38.0 | 42.0 | 13.0 | — | 4.7 | 0.03 | 1.5 | 0.4 | — |
| Incoloy alloy 783 | 28.5 | 26.0 | 34.0 | 3.0 | 3.0 | 5.4 | 0.1 | — | — |
| Incoloy alloy 718 | 52.5 | 18.5 | — | 19.0 | 5.13 | 0.50 | 0.90 | .18 | 3.05 Mo |
| Thermo-Span | 25 | 34 | 29 | 5.5 | 4.8 | 0.5 | 0.8 | 0.3 | — |
| Haynes alloy 242 | 64 | 1.0 | 1.25 | 8.0 | — | 0.25 | — | 0.4 | 25.0 Mo |
| Nilo alloy 36 | 36.0 | 64.0 | — | — | — | — | — | — | — |
| Nilo alloy 42 | 42.0 | 58.0 | — | — | — | — | — | — | — |
| Incoloy alloy 908 | 49 | 41 | — | 4 | 3 | 1 | 1.5 | — | — |

Other controlled expansion alloys include: Ni—Fe—Co Incoloy alloy 904, and Inconel alloy 625.

Titanium alloys having controlled or low coefficient of thermal expansion include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

These alloys are illustrative of the invention and other alloys may be used having low coefficient of thermal expansion and preferably with high oxidation resistance.

As well as having a low coefficient of thermal expansion, the metal fibers should high strength at elevated temperatures for high temperature applications, such as for use with molten aluminum. For example, stainless steels have high oxidation resistance and good strength at room temperature, but at elevated temperatures, strength drops off as temperature rises. For example, when stainless steels are compared to nickel based alloys at 1200° F. the yield strength properties (0.2% offset) are inferior, as will be seen in the following Table.

| Material | YS KSI at 1200° F. |
|---|---|
| 302 SS | 12 |
| 321 SS | 19 |
| 309 SS | 26 |
| 410 SS | 27 |
| Hastealloy X | 40 |
| Hastealloy S | 47 |
| Waspalloy | 100 |
| Inconel X-750 | 103 |
| Inconel IN-718 | 148 |

In the present invention, it is preferred that such alloys be used in fibrous form and may be used in mat form where chopped fibers are formed into mats before using in the mold. Preferably, the fibers are less than about 5 inches long with a diameter of less than 50 mils.

It will be appreciated that plasticizing agents may be used to facilitate intrusion of the fibers with the slurry. Further, infiltration of the fibers can be further facilitated by applying vibrating and/or vacuum means to the mold to improve impregnation of the fibers with slurry. After the slurry has been added, typically the refractory body has a green strength in about 4 to 5 hours. For most compositions, good green strength is obtained overnight. Thereafter, the refractory body can be treated at an elevated temperature to remove water, typically in the range of 150° to 750° C.

Refractory bodies formed using the low coefficient of thermal expansion of the present invention have high levels of strength and are resistant to cracking at elevated temperatures because of the controlled coefficient of thermal expansion. Prior material using steel reinforcing undergoes selective oxidation of the steel. Oxidation continues progressively until overall strength is compromised due to loss of reinforcement and eventually the material fails.

The refractory bodies of the present invention are useful in molten metal treatment processes. For example, the refractory bodies can be formed to accept electric heaters and used for baffle heaters to treat molten metal, such as aluminum as well as other metals.

Further, the refractory bodies can be used as liners and blocks for molten metal furnaces and find great use in high temperature applications where thermal stress is a concern.

In another aspect of the invention, the refractory may be used to form a trough member for conveying molten metal from a molten metal source, e.g., holding furnace, to a work station such as a processing station, e.g., degasser or casting station (FIG. 1).

Figure 2:
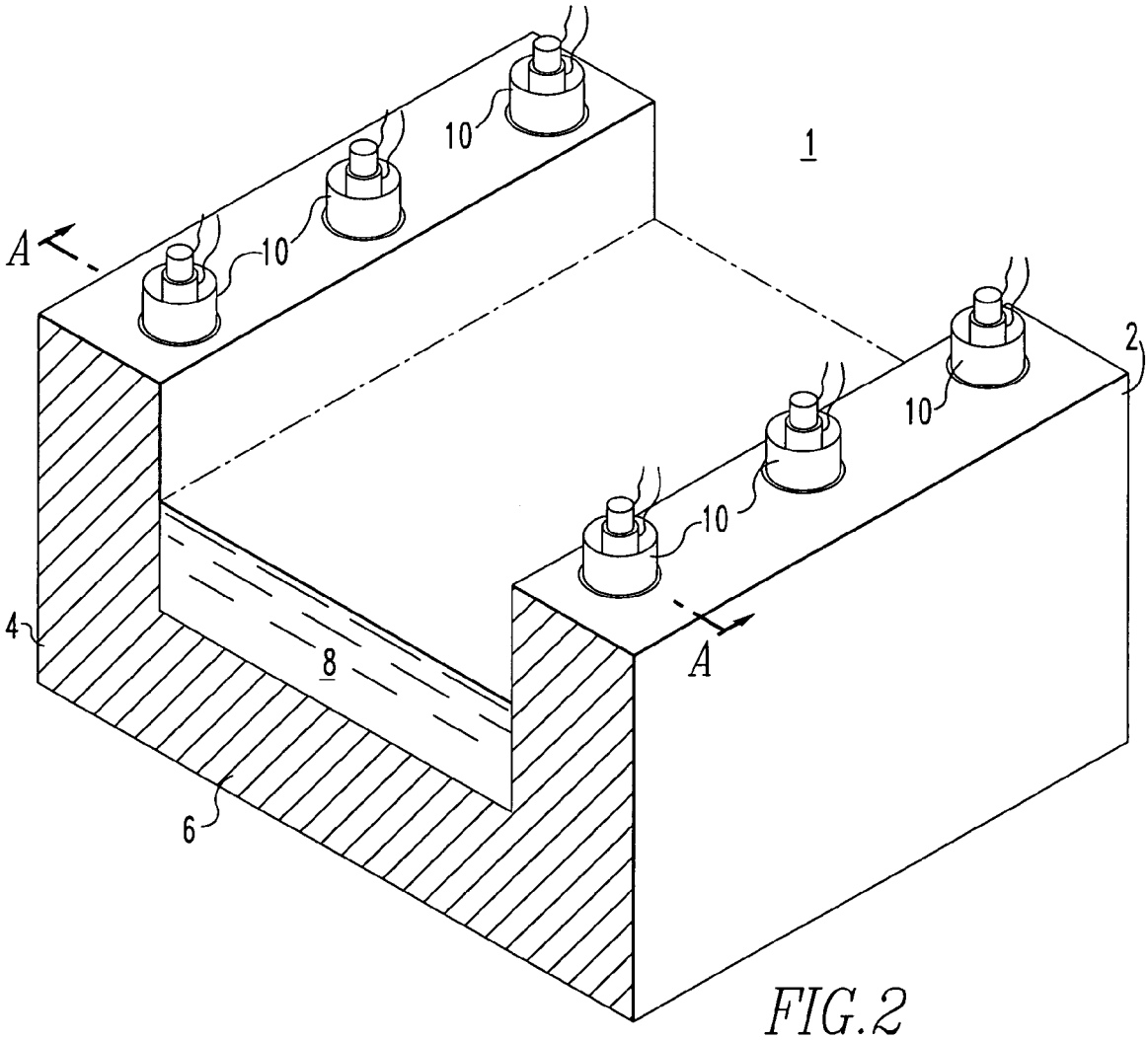
FIG. 2 is a schematic of a section of the trough in FIG. 1.

The trough member can be any shape but preferably has a U-shaped configuration such as shown, for example, in FIG. 2. The trough member illustrated in FIG. 2 has sides 2 and 4 connected to bottom 6 for containing and flowing molten metal 8. In FIG. 2, leads 10 are shown connected to electric heaters positioned in walls or sides 2 of trough member 1 for the purpose of adding heat to the molten metal as it passes along the trough. Although not shown in FIG. 2, trough member 1 can be provided with a lid to minimize heat loss.

Figure 3:
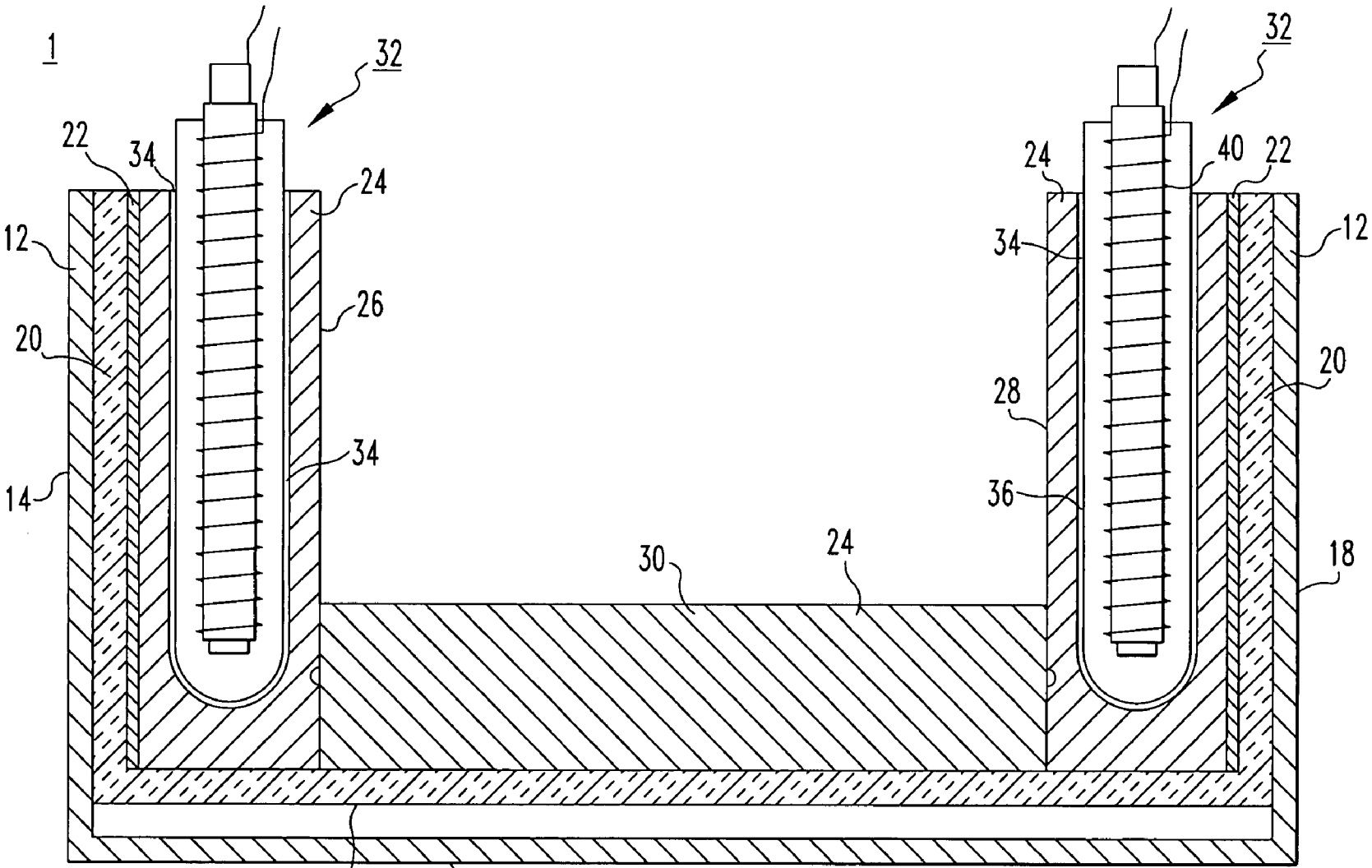
FIG. 3 is a cross section of a trough member along the line A—A of FIG. 2 in accordance with the invention.

Referring now to FIG. 3, there is shown a cross section along the line A—A of FIG. 2 of the trough member in accordance with the invention. The trough member comprises a metal shell 12 which is generally U-shaped and extends down side 14, along bottom 16 and up side 18. A layer of insulation 20 is provided inside metal shell 12 and extends down side 14, along bottom 16 and up side 18. On sides 14 and 18, a reflective sheet 22 of metal may be provided to reflect heat inwardly towards the molten metal in the trough. The reflective sheet may be comprised of any metal having a reflective surface such as, for example, stainless steel or nickel steel.

An inner liner 24 of refractory is provided against the reflective sheet. Refractory liner 24 may be provided as a monolith or it may be comprised of side panels 26 and 28 maintained or anchored in position by bottom panel 30. Refractory liner 24 extends down side 14 along bottom 16 and up side 18. If it is provided in sections then sides 26 and 28 are closely fitted with bottom 30 and preferably sealed using a refractory cement to contain the molten aluminum. Electric heating elements 32 are shown located in refractory sides 26 and 28 for connecting to a source of electric power. If desired, heating elements may be placed in bottom 30. Further, in some applications, it may be sufficient to provide heating elements in just one side. The electrical heating elements may be electrically connected in a series circuit and the heaters can be controlled as part of a closed loop control system. In another aspect of the invention, the electrical power input to the heaters can be modulated or controlled by a controller to avoid overheating the element.

Liner 24 may be fabricated from any material which is resistant to attack by molten metal such as molten aluminum. Thus, liner 24 should be comprised of a material having high thermal conductivity, high strength, good impact resistance, low thermal expansion and oxidation resistance. Liner 24 may be fabricated from silicon carbide, silicon nitride, magnesium oxide, spinel, carbon, graphite or a combination thereof. Liner 24 may be reinforced with metal fibers as disclosed earlier for strength. Metal fibers having a high heat conduction may be used for purposes of facilitating transfer heat from the heater to the molten metal in the trough member. Thus, metal fibers such as copper fibers may be used with or without reinforcing fibers. The liner material is available from Wahl Refractories under the tradename "Sifca®", or from Carborundum Corporation under the tradename "Refrax® 20" or "Refrax® 60".

In forming refractory liner 24, preferably holes 34 having smooth walls are formed therein during casting for insertion of heaters 32 thereinto and further it is preferred that heaters 32 have a snug fit with holes or receptacles 34 for purposes of transferring heat to refractory liner 24. Thus, it is preferred to minimize the air gaps between the heater and the refractory liner. However, sufficient clearance should be provided to permit extraction of the heating element, if necessary. Tubes or sleeves 36 may be cast in place in refractory liner 24 to provide for the smooth surface. Preferably, tubes 36 have a strength which permits their collapse to avoid cracking the liner material upon heating. If the tubes are metal, preferred materials are titanium or Kovar® or other metals having a low coefficient of expansion, e.g., less than $7.5\times10^{-6}$ in/in/° F. Preferably, tubes 36 are comprised of a refractory material substantially inert to molten aluminum. Thus, if after extended use, refractory liner 24 becomes damaged and cracks permitting molten aluminum to intrude to heater 32, it is desirable to protect against attack by the molten aluminum. That is, it is preferred to use a refractory tube 36 to contain heater 32 and protect it from molten metal. Refractory tube 36 may be comprised of a material such as mullite, boron nitride, silicon nitride, silicon aluminum oxynitride, graphite, silicon carbide, zirconia, stabilized zirconium and hexalloy (a pressed silicon carbide material) and mixtures thereof Such materials have a high thermal conductivity and low coefficient of expansion. The refractory tubes may be formed by slip casting or pressure casting and fired to provide the refractory or ceramic material with suitable properties resistant to molten aluminum. Metal composite material such as described in U.S. Pat. No. 5,474,282, incorporated herein by reference, may be used.

For purposes of providing extended life of the heated liner, particularly when it is in contact with molten aluminum, it is preferred to use a non-wetting agent applied to the surface of the liner or incorporated in the body of the liner during fabrication. It is important that such non-wetting agents be carefully selected, particularly when the heating element is comprised of an outer metal tube. That is, when heaters 32 are used in the receptacles or holes in the liner which employ a nickel-based metal sheath, the non-wetting agent should be selected from a material non-corrosive to the nickel-base metal sheath. It has been discovered that, for example, sulfur containing non-wetting agents, e.g., barium sulfate, are detrimental. The sulfur from the non-wetting agent reacts with the nickel-based material of the metal sheath or sleeve. The sulfur reacts with the nickel forming nickel sulfide which is a low melting compound. This reaction destroys the protective, coherent oxide of the nickel-based sheath and continues until perforations or holes result in the sheath and destruction of the heater. It will be appreciated that the reaction is accelerated at temperatures of operation e.g., 1400° F. Other materials that are corrosive to the nickel-based sheath include halide and alkali containing non-wetting agents. Non-wetting agents which have been found to be satisfactory include boron nitride and barium carbonate and the like because such agents do not contain reactive material or components detrimental to the protective oxide on the metal sleeve of the heater.

In another aspect of the invention, a thermocouple (not shown) may be placed in the holes in the liner along with the heating element. This has the advantage that the thermocouple provides for control of the heating element to ensure against overheating of element 32. That is, if the thermocouple senses an increase in temperature beyond a specified set point, then the heater can be shut down or power to the heater reduced to avoid destroying the heating element.

For better heat conduction from the heater to the liner material, a contact medium such as a low melting point, low vapor pressure metal alloy may be placed in the heating element receptacle in the liner.

Alternatively, a powdered material may be placed in the heating element receptacle. When the contact medium is a powdered material, it can be selected from silica carbide, magnesium oxide, carbon or graphite. When a powdered material is used, the particle size should have a median particle size in the range from about 0.03 mm to about 0.3 mm or equivalent U.S. Standard sieve series. This range of particle size greatly improves the packing density of the powder and hence the heat transfer from the element to the liner material. For example, if mono-size material is used, this results in a one-third void fraction. The range of particle size reduces the void fraction below one-third significantly and improves heat transfer. Also, packing the particle size tightly improves heat transfer.

Heating elements that are suitable for use in the present invention are available from Watlow AOU, Anaheim, Calif. or International Heat Exchanger, Inc., Yorba Linda, Calif., and may operate at 120 volts or less.

The low melting metal alloy can comprise lead-bismuth eutectic having the characteristic low melting point, low vapor pressure and low oxidation and good heat transfer characteristics. Magnesium or bismuth may also be used. The heater can be protected, if necessary, with a sheath of stainless steel; or a chromium plated surface can be used. After a molten metal contact medium is used, powdered carbon may be applied to the annular gap to minimize oxidation.

Any type of heating element 32 may be used. Because the liner extends above the metal line, the heaters are protection from the molten aluminum. Further, because the liner supplies the heat to the metal, small diameter heating elements can be used.

Using the liner heater of the invention has the advantage that no additional space is needed for heaters because they are placed in the liner.

In the present invention, it is important to use a heater control. That is, for efficiency purposes, it is important to operate heaters at highest watt density while not exceeding the maximum allowable element temperature. As noted earlier, a thermocouple placed in holes in the liner senses the temperature of the heater element. The thermocouple can be connected to a controller such as a cascade logic controller to integrate the heater element temperature into the control loop. Such cascade logic controllers are available from Watlow Controls, Winona, Minn., designated Series 988.

For purposes of the present invention, watt density is an expression of heat flux; that is, the quantity of heat passing through a surface of unit surface area per unit time. Power per unit area is one such expression. The driving force for heat flux is temperature gradient. As the temperature gradient increases, the heat flux also increases.

Heaters are designed with a watt density that allows the heater to safely operate within the prevailing heat flux conditions. If the heat extraction rate from a heater is not commensurate with the design watt density, the heater element temperature increases. The consequential increase in temperature gradient results in an increase in heat flux. In situations where heat flux is limited by thermal conductivity or other heat transfer considerations, the heater element temperature may reach unacceptably high levels.

Conversely, if the design watt density of an electric heater is intentionally limited to restrict the maximum attainable heating element temperature to a safe value, heating rate can be compromised. During a heat-up from cold start situation, for example, the temperature gradient is high, and therefore the heat transfer rate is high. A high watt density heater can be safely used. As heat-up progresses, however, the temperature relaxes and heat transfer is reduced. Since energy (heat) transfer from the electric heater is reduced, the heater element temperature will increase. Over-temperature will result.

Cascade logic control allows for the use of high watt density heaters, however, the power input to the heater is modulated in accordance with temperature gradient conditions. In cascade logic control, two thermocouple positions are used. The first, or primary position is the process or metal temperature itself. An operator establishes the set point for process temperature. The second input is the heater element or sheath temperature. In some systems, the primary input establishes heater power input by an on/off, proportional, or proportional integrating derivative (PID) control circuit. The secondary input, or sheath temperature, usually functions as a high temperature safety limit. If this limit is reached, the system either shuts down, or cycles on/off. Cascade logic uses the secondary input in a second PID control loop. In combination with the primary input, the secondary loop provides proportional power input to the heater element. Watt density is therefore maximized for any given temperature gradient condition. The principle of cascade logic control is important to heater life and maximizing heat flux input to the metal.

When refractory tubes are used to contain the heaters, it is preferred to coat the inside of the tube with a black colored material such as black paint resistant to high temperature to improve heat conductivity.

When the heaters are used in the liner, typically each heater has watt density of about 12 to 50 watt/in$^2$.

While heaters have been shown located in the liner, it will be appreciated that heaters may be inserted directly (not shown) into molten metal through lid or side 28. Such heaters require protective sleeves or tubes to prevent corrosive attack by the molten aluminum. Heaters disposed directly in the melt have the advantage of higher watt densities.

While it has been noted that for better heat conduction from the heater to the refractory, a low melting metal alloy or a powdered material may be used, it has been found that a glass amalgam molten or softened (having a softening point, SP) at molten aluminum temperatures can be used to improve heat transfer or conduction to the refractory liner. The amalgam may be added in powdered or molten form to the receptacle containing the heater.

Any amalgam that is molten or softened at about 1400° F. or the temperature of molten aluminum conveyed by the trough member may be used. Examples of such amalgams, by weight, are as follows:

| | SP° C. | $SiO_2$ (%) | PbO (%) | $B_2O_2$ (%) | $Na_2O$ (%) | $K_2O$ (%) | ZnO (%) | $Bi_2O_3$ (%) |
|---|---|---|---|---|---|---|---|---|
| 1 | 475 | 44 | 42 | 10.5 | 3.5 | — | — | — |
| 2 | 550 | 51 | 43 | 2.5 | — | 3.5 | — | — |
| 3 | 335 | 45 | 47 | 8 | — | — | — | — |
| 4 | 338 | — | 85 | 15 | — | — | — | — |
| 5 | 553 | 32 | 60 | 3 | — | 5 | — | — |
| 6 | 476 | 20 | 60 | 15 | 5 | — | — | — |
| 7 | — | — | 15 | 2 | — | — | 5 | 75 |

For purposes of the invention, an amalgam is a material involving a low melting point solvent and at least one solute component. In the case of an amalgam, a nominal composition is selected with a liquidus temperature above the maximum anticipated service temperature. A mechanical mixture of the components is made, and when heated, results in melting of the solvent and subsequent dissolution of the solute elements. The liquidus temperature follows the value predicted by the multi-component phase diagram and typically first decreases in the case of a eutectic system. As the amount of dissolved solute passes through the eutectic composition, however, the liquidus begins to increase and progressively increases until the service temperature is reached. The amalgam then solidifies. The liquidus temperature may continue to increase as a result of solid state diffusion of solute, this mechanism being known as diffusion solidification.

To improve heat conduction in liner 24, copper metal powder or pellets and preferably fibers may be added to the refractory in the same way as described herein with respect to the strengthening metal fibers. It has been discovered that the use of copper fibers significantly improves heat conduction through the refractory liner to the molten aluminum. Typical fiber lengths are about 1.3 inch long and about 0.0025 inch in diameter and the copper fibers can comprise 3–35 vol. % of the refractory liner.

The copper fibers can result in up to at least 30% improvement in heat conduction through said refractory.

While the trough member has been illustrated without a lid or cover, it will be understood that a suitable lid or cover comprised of suitable material such as refractory or metal may be provided to contain heat.

While the invention has been particularly illustrated for molten aluminum, its application can be applied to other molten materials or molten metals, including without limitation, copper, lead, iron, magnesium and zinc, for example.

While the invention has been described in terms of preferred embodiments, the claims appended hereto are intended to encompass other embodiments which fall within the spirit of the invention.

What is claimed is:

1. A trough member for heating molten aluminum as it flows from a molten aluminum source to a processing operation, the trough members comprised of:

a first side and a second side, said first and said second sides having outside surfaces, said sides formed from a ceramic material resistant to attack by molten aluminum, said first side and second side having heating element receptacles provided therein, said receptacles having protection tubes therein, said tubes comprised of a material selected from the group consisting of mullite, boron nitride, silicon carbide, silicon nitride, graphite, silicon aluminum oxynitride and titanium; and electric heating elements positioned in said protection tubes in at least one side, said heating elements designed to heat molten aluminum as it flows along said trough member from said source.

2. The trough in accordance with claim 1 wherein said receptacles contain a powdered material is selected from the group consisting of silicon carbide, magnesium oxide, carbon and mixtures thereof.

3. The trough in accordance with claim 1 wherein said receptacles contain a contact medium which is an amalgam.

4. The trough in accordance with claim 1 wherein said receptacles contain a contact medium, the contact medium selected from the group consisting of powdered material, low melting metal and a glass material.

5. The trough in accordance with claim 1 wherein said ceramic material contains a copper medium for improved heat transfer.

6. A trough member for heating molten aluminum as it flows from a molten aluminum source to a processing operation, the trough members comprised of:

a first side and a second side, said first and said second sides having outside surfaces, said sides formed from a ceramic material resistant to attack by molten aluminum, said first side and second side having heating element receptacles provided therein, said receptacles having protection tubes therein, said tubes comprised of a material selected from the group consisting of mullite, boron nitride, silicon carbide, silicon nitride, graphite, silicon aluminum oxynitride and titanium, said first and second sides having a heat-reflective layer disposed on said outside surfaces; and electric heating elements positioned in said protection tubes in at least one side, said heating elements designed to heat molten aluminum as it flows along said trough member from said source.

* * * * *